US007389063B2

(12) United States Patent
Tomita et al.

(10) Patent No.: US 7,389,063 B2
(45) Date of Patent: Jun. 17, 2008

(54) IMAGE FORMATION SYSTEM WITH AUTHENTICATION FUNCTION

(75) Inventors: Atsushi Tomita, Toyohashi (JP); Hiroshi Sugiura, Hoi-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 211 days.

(21) Appl. No.: 11/025,719

(22) Filed: Dec. 30, 2004

(65) Prior Publication Data

US 2006/0104656 A1 May 18, 2006

(30) Foreign Application Priority Data

Nov. 18, 2004 (JP) ..... 2004-335035

(51) Int. Cl.
*G03G 15/00* (2006.01)

(52) U.S. Cl. ..... 399/80

(58) Field of Classification Search ..... 399/8, 399/80; 713/168, 169, 182
See application file for complete search history.

(56) References Cited

U.S. PATENT DOCUMENTS

| | | | | |
|---|---|---|---|---|
| 5,784,664 | A * | 7/1998 | Nakamura et al. | 399/8 |
| 6,064,836 | A * | 5/2000 | Nakamura et al. | 399/8 |
| 7,058,332 | B2 * | 6/2006 | Moroi | 399/80 |
| 7,119,916 | B2 * | 10/2006 | Kato et al. | 358/1.15 |
| 7,130,066 | B1 * | 10/2006 | Kanematu | 358/1.15 |

FOREIGN PATENT DOCUMENTS

| | | |
|---|---|---|
| JP | 8-65425 | 3/1996 |
| JP | 10-10935 | 1/1998 |
| JP | 2000-206835 A | 7/2000 |
| JP | 2002-77480 | 3/2002 |
| JP | 2002-111917 | 4/2002 |
| JP | 2003-16039 | 1/2003 |
| JP | 2003-264551 | 9/2003 |
| JP | 2004-213077 A | 7/2004 |
| JP | 2005-79681 A | 3/2005 |

OTHER PUBLICATIONS

Japanese Office Action, with English-Language Translation, dated Feb. 19, 2008.

* cited by examiner

*Primary Examiner*—Robert Beatty
(74) *Attorney, Agent, or Firm*—Buchanan Ingersoll & Rooney PC

(57) ABSTRACT

A user name entered on a user authentication screen is searched and if it found to be an unregistered user name a different, registered image formation apparatus is asked to act as a proxy to perform user authentication. If the apparatus returns "OK" a decision is made that the authentication of interest is "OK" and the authentication process ends. If all of the image formation apparatuses registered in a proxy authentication apparatus registration table are requested to perform user authentication do not provide an authentication "OK" a decision is made that the authentication of interest is "NG" and the authentication process ends. Thus in networked environment an image formation apparatus can be provided that can eliminate the necessity of registering information for user authentication with all image formation apparatuses and also prevent improper use by a user registered with an unintended image formation apparatus.

5 Claims, 11 Drawing Sheets

FIG.5

| USER NAME | PASSWORD |
|---|---|
| ito | airk6sers |
| kato | se953es |
| sato | di42pe7 |
| suzuki | pertes9242q |
| : | : |

FIG.6

| No. | IP ADDRESS |
|---|---|
| 1 | 192.168.0.1 |
| 2 | 192.168.0.2 |
| 3 | 192.168.0.13 |
| 4 | 192.168.0.51 |
| : | : |

IMAGE FORMATION SYSTEM WITH AUTHENTICATION FUNCTION

This application is based on Japanese Patent Application No. 2004-335035 filed with the Japan Patent Office on Nov. 18, 2004, the entire content of which is hereby incorporated by reference.

BACKGROUND OF THE INVENTION

1. Field of the Invention

The present invention relates to image formation apparatuses and systems and particularly to such apparatuses and systems that can authenticate whether a user attempting to use the apparatus is a user authorized to use the apparatus and if the user is authenticated as an authorized user they can provide control to permit the user to use the apparatus.

2. Description of the Related Art

In conventional image formation apparatuses and systems an identification (ID) and a password are set for each user. When the user utilizes the image formation apparatus or system, the user is authenticated by the ID and password specific to the user.

Japanese Laid-Open Patent Publication No. 8-65425 discloses a digital copier network system connecting to a plurality of digital copiers on a network to allow a first digital copier to transmit to a second digital copier image data to be copied thereby to maximally increase productivity attributed to copy rate.

Japanese Laid-Open Patent Publication No. 10-10935 discloses an image formation apparatus matching a user input identifier to a previously registered identifier and if they do not match the apparatus makes an inquiry asking another copier whether the copier has an identifier matching the user's identifier and if so the apparatus permits the user to operate it.

Japanese Laid-Open Patent Publication No. 2002-77480 discloses an image formation apparatus management system allowing one image formation apparatus, having a management device connected thereto, to notify another image formation apparatus, also having a management device connected thereto, of a setting for the former apparatus's management device when the apparatuses perform tandem print.

Japanese Laid-Open Patent Publication No. 2002-111917 discloses a system operative in response to instructions received from a client PC to perform a large amount of private printing by a color digital copier connected on a network. When the color digital copier verifies a password to perform the private printing, single-printing at a single color digital copier as previously set by the client PC's instruction or tandem print at two color digital copiers can be switched.

Japanese Laid-Open Patent Publication No. 2003-16039 discloses a system in which when a terminal device utilizes services provided by a service provision server the user who desires to utilize the service provision server is authenticated by an authentication server independent from the service provision server. Whenever the authentication server authenticates a user, the user's ID is updated and transmitted to a terminal. The terminal stores the transmitted ID. By using the stored ID in a subsequent authentication, the ID is updated for each use to prevent improper use of the ID and password.

Japanese Laid-Open Patent Publication No. 2003-264551 discloses a method allowing an authentication device to authenticate an account and password transmitted from a mobile phone by radio and on the Internet. If the authentication is "OK" a mailing device creates a URL with a key attached thereto and transmits the created URL to the accessing mobile phone by mail. The mobile phone returns URL with key, which is confirmed and if the transmitted URL with the key is returned within a predetermined period of time the service of interest is performed so that a communications terminal and server's security is ensured.

<First Disadvantage>

As has been described above, the necessity of registering with an apparatus a user name and password or similar user information permitting a user to use the apparatus is eliminated by making an inquiry to another image formation apparatus to verify a user input user name and password. If the inquiry is made in an networked environment to an indefinite number of image formation apparatuses, however, a user registered with an unintended image formation apparatus would also be authorized and allowed to improperly use the image formation apparatus of interest.

<Second Disadvantage>

If a plurality of image formation apparatuses tandemed to process a single print job (or provide tandem print) to achieve increased productivity each authenticate the same user, the authentication process would be time-consuming, reducing the effect of the tandem print intended to achieve increased productivity. In particular, if user authentication is performed by a server external to the image formation apparatus and dedicated to authentication, the authentication process can in the worst case require a period of several minutes and thus would significantly impair the productivity of tandem print.

SUMMARY OF THE INVENTION

The present invention has been made to overcome the first and second disadvantages described above.

A first object of the present invention is to provide an image formation apparatus and system that can eliminate the necessity of registering information for user authentication with all image information apparatuses in a networked environment and also prevent improper use by a user registered with an unintended image formation apparatus.

A second object of the present invention is to provide an image formation apparatus and system that can overcome productivity impaired as a plurality of image formation apparatuses performing user authentication and link together to perform tandem print each perform user authentication.

To achieve the above objects the present invention in one aspect provides an image formation apparatus connectable to a different image formation apparatus on a network, including: an input device operated to input user identification information; a user register registering user identification information of a user authorized to use the image formation apparatus; a verifier performing a verification as to whether the user identification information input via the input device matches that registered with the user register; a proxy apparatus register registering a different image formation apparatus requested to act as a proxy to perform the verification; a verification requester operative in response to the verifier providing a failed verification to transmit the user identification information received from the input device to an image formation apparatus registered with the proxy apparatus register to request the image formation apparatus to verify the user; a verification receiver receiving a verification from the image formation apparatus requested by the verification requester to verify the user; and an authorizer operative in response to the verification received being successful to authorize use of the apparatus of interest.

The present invention in another aspect provides an image formation system including at least two image formation apparatuses interconnected on a network. A first one of the image formation apparatuses includes an input device operated to input user identification information, a first user register registering user identification information of a user authorized to use the first image formation apparatus, a verifier performing a verification as to whether the user identification information input via the input device matches that registered with the first user register, a proxy apparatus register registering a different image formation apparatus requested to act as a proxy to perform the verification, a verification requester operative in response to the verifier providing a failed verification to transmit the user identification information received from the input device to a second image formation apparatus registered with the proxy apparatus register to request the second image formation apparatus to verify the user, a verification receiver receiving a verification from the second image formation apparatus requested by the verification requester to verify the user, and an authorizer operative in response to the verification received being successful to authorize use of the first image formation apparatus. The second image formation apparatus includes an acceptor accepting the user identification information transmitted from the verification requester, a second user register registering user identification information of a user authorized to use the second image formation apparatus, a proxy verifier performing verification as to whether the user identification information received by the acceptor matches that registered with the second user register, and a verification transmitter transmitting to the first image formation apparatus a verification provided by the proxy verifier.

The present invention in still another aspect provides an image formation system including at least two image formation apparatuses interconnected on a network. A first one of the image formation apparatuses includes an input device operated to input user identification information, a first user register registering user identification information of a user authorized to use the first image formation apparatus, a first verifier performing a verification as to whether the user identification information input via the input device matches that registered with the first user register, a tandem apparatus register registering a different image formation apparatus performing tandem print, a generator generating a plurality of tandem print data from print data, and a transmitter operative in response to the first verifier providing a successful verification to transmit to a second image formation apparatus registered with the tandem apparatus register the tandem print data together with verification information indicating that the verification has succeeded. The second image formation apparatus includes an input device operated to input user identification information, a receiver receiving print data, a second user register registering user identification information of a user authorized to use the second image formation apparatus, a second verifier performing a verification as to whether the user identification information input via the input device matches that registered with the second user register, and a controller providing control to perform an image formation process without the second verifier's verification if print data received from the receiver includes information of verification by a different image formation apparatus.

The present invention in still another aspect provides an image formation apparatus connectable to a different image formation apparatus on a network, including: an input device operated to input user identification information; a user register registering user identification information of a user authorized to use the image formation apparatus; a verifier performing a verification as to whether the user identification information input via the input device matches that registered with the user register; a tandem apparatus register registering a different image formation apparatus performing tandem print; a generator generating a plurality of tandem print data from print data; and a transmitter operative in response to the verifier providing a successful verification to transmit to a image formation apparatus registered with the tandem apparatus register the tandem print data together with verification information indicating that the verification has succeeded.

The present invention in still another aspect provides an image formation apparatus connectable to a different image formation apparatus on a network, including: an input device operated to input user identification information; a receiver receiving print data; a user register registering user identification information of a user authorized to use the image formation apparatus; a verifier performing a verification as to whether the user identification information input via the input device matches that registered with the user register; and a controller providing control to perform an image formation process without the verifier's verification if print data received from the receiver includes information of verification by a different image formation apparatus.

The present invention in still another aspect provides an image formation system including at least two image formation apparatuses interconnected on a network, and a user verification device receiving user identification information transmitted from an image formation apparatus, and verifying whether the user identification information matches that of a user authorized to use the source image formation apparatus. A first one of the image formation apparatuses includes an input device operated to input user identification information, a first external verifier requesting the user verification device to perform verification of the user identification information input via the input device, and receiving the verification, a tandem apparatus register registering a different image formation apparatus performing tandem print, a generator generating a plurality of tandem print data from print data, and a transmitter operative in response to the first external verifier providing a successful verification to transmit to a second image formation apparatus registered with the tandem apparatus register the tandem print data together with verification information indicating that the verification has succeeded. The second image formation apparatus includes an input device operated to input user identification information, a receiver receiving print data, a second external verifier requesting the user verification device to perform verification of the user identification information input via the input device, and receiving the verification, and a controller providing control to perform an image formation process without the second external verifier's verification if print data received from the receiver includes information of verification by the user verification device.

In accordance with the present invention another image formation apparatus acting as a proxy to verify user ID information is registered and requested to act as a proxy to perform verification. Thus an image formation apparatus and system can be provided that can eliminate the necessity of registering information for user authentication with all image information apparatuses in a networked environment and also prevent improper use by a user registered with an unintended image formation apparatus.

Furthermore an image formation apparatus and system can be provided that can transmit information to be verified in tandem print to avoid impaired productivity attributed to individual image formation apparatuses each verifying user ID information.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 5 shows an example of a user table having stored therein a user's user name and password permitting the user to use the apparatus.

FIG. 6 shows an example of a proxy authentication apparatus registration table having stored therein an IP address of another image information apparatus requested to act as a proxy to perform user authentication.

DESCRIPTION OF THE PREFERRED EMBODIMENTS

First Embodiment

Hereinafter embodiments of the present invention will be described.

Figure 1:
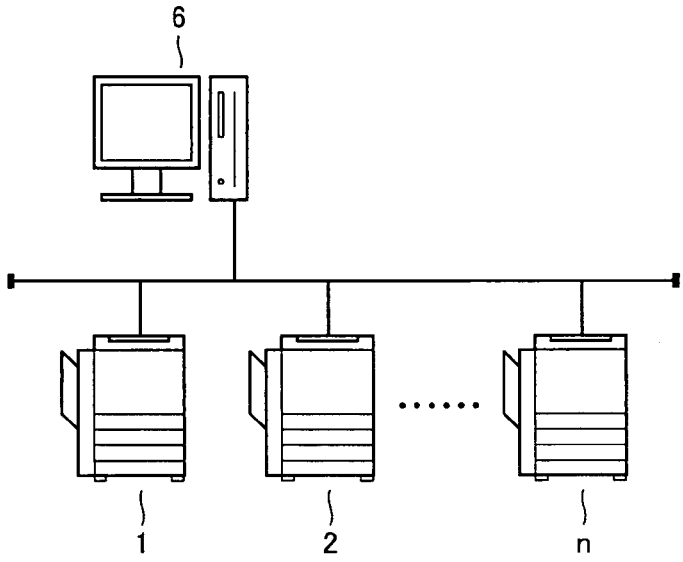
FIG. 1 shows a configuration of an image formation system in a first embodiment.

With reference to FIG. 1 an image formation system includes a plurality of image formation apparatuses 1-*n* and a terminal device 6 connected together on a network.

Image formation apparatus 1-*n* form on a sheet a copy of an image of an original scanned and an image generated from print data transmitted from terminal device 6.

Figure 2:
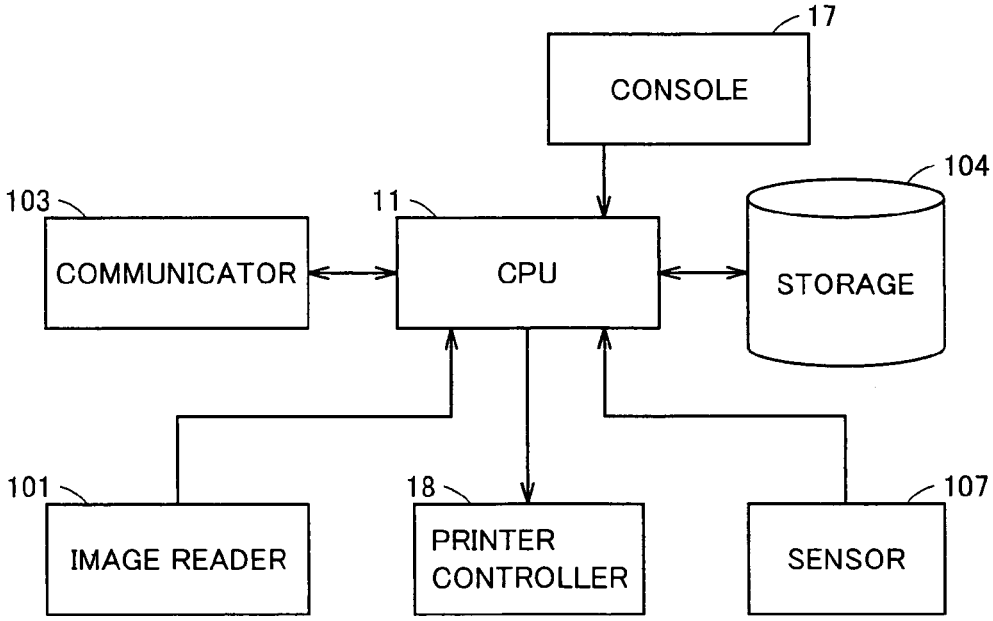
FIG. 2 shows an internal configuration of an image formation apparatus.

FIG. 2 is a block diagram showing a hardware configuration of the FIG. 1 image formation apparatus 1. Image formation apparatuses 2-*n* have the same configuration as image formation apparatus 1.

With reference to the figure the image formation apparatus includes a CPU 11 generally controlling the apparatus, an image reader 101 reading image data from an original, a printer controller 18 controlling a printer printing an image on a sheet, a communicator 103 operative to perform short-distance radio communications and connect a printing device to a line, a storage 104 storing job data, authentication data and the like, a console 17 serving as an interface with a user, and a sensor 107 for example detecting an amount of a consumable available.

Figure 3:
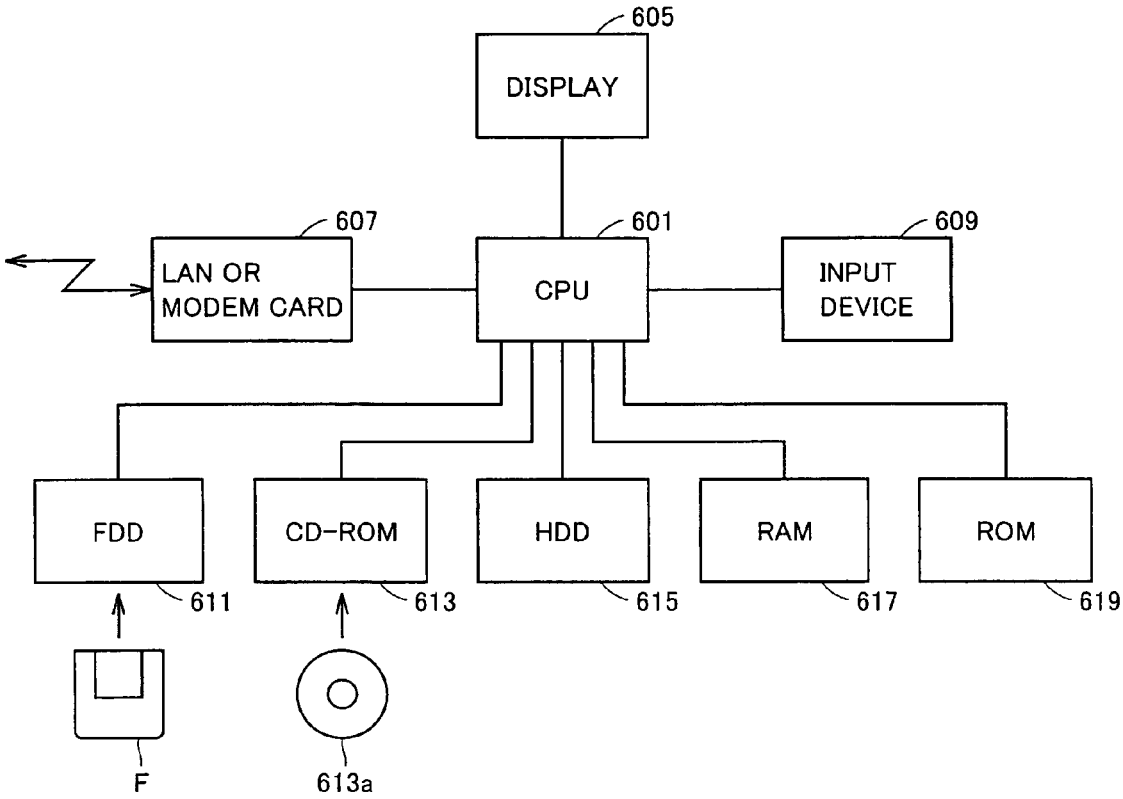
FIG. 3 is a block diagram showing a hardware configuration of a terminal device 6 shown in FIG. 1.

FIG. 3 is a block diagram showing a hardware configuration of terminal device 6 shown in FIG. 1

With reference to the figure, terminal device 6 includes a CPU 601 generally controlling the device, a display 605, a local area network (LAN) card 607 (or a modem card) used to connect to a network, for external communications and the like, an input device 609 configured for example of a keyboard, a mouse and the like, a flexible disk drive 611, a CD-ROM drive 613, a hard disk drive 615, a RAM 617 and a ROM 619.

Flexible disk drive 611 allows reading data such as a program recorded on a flexible disk F, and CD-ROM drive 613 allows reading data such as a program recorded on a CD-ROM 613*a*.

Figure 4:
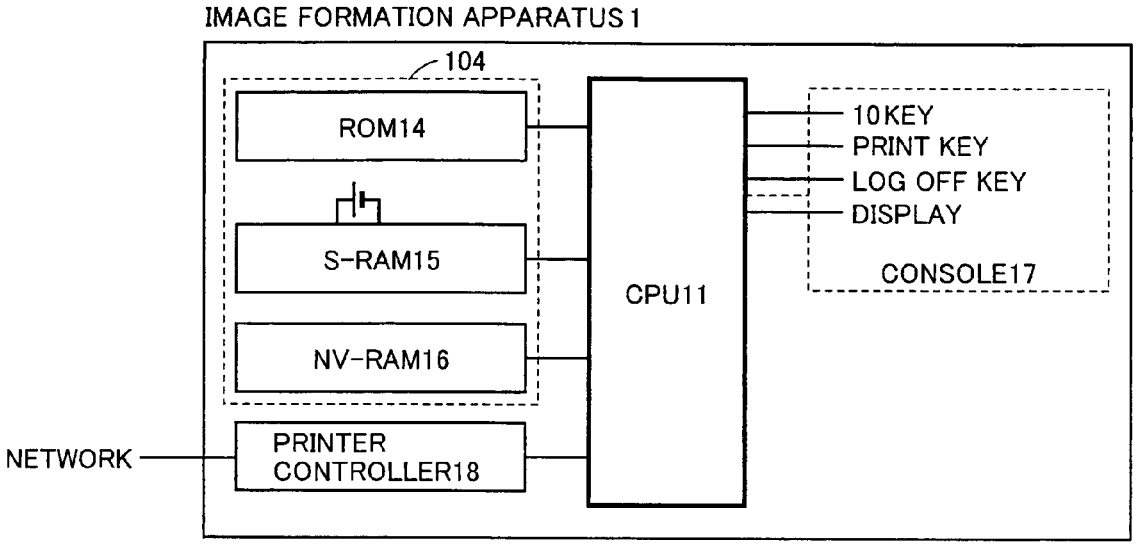
FIG. 4 shows an internal configuration of an image formation apparatus.

FIG. 4 shows an internal configuration of image formation apparatus 1. Image formation apparatuses 1-*n* have the same internal configuration.

The image formation apparatus 1 CPU 11 has connected thereto a ROM 14 having a control program stored therein, a battery backed up, working system RAM (S-RAM) 15, a non-volatile memory (NV-RAM) 16 storing a variety of settings involved in formatting images. Note that ROM 14, S-RAM 15, and NV-RAM 16 are included in storage 104 of FIG. 2.

As has been described with reference to FIG. 2, CPU 11 has connected thereto console 17 including keys used to enter a variety of inputs, a display, and the like.

FIG. 5 shows a specific example of a user table storing user names and passwords, correlated with each other.

Console 17 is operated to input a user name and a password, which are stored in the table, correlated with each other, as shown in the figure.

Similarly, an IP address of another image formation apparatus requested to verify user names and passwords is also input via console 17 and stored to non-volatile memory 16.

FIG. 6 shows a specific example of a proxy authentication apparatus registration table having stored therein an IP addresses of another image formation apparatus requested to verify a user name and a password.

As shown in the figure, a user name input via console 17 and an IP address of another image formation apparatus requested to verify a password are stored in the table, correlated with each other.

Furthermore CPU 11 has printer controller 18 connected thereto and printer controller 18 has a network cable connected thereto.

Image formation apparatus 1 receives print data from terminal device 6 on a network by printer controller 18 and from the print data forms an image on a sheet.

Furthermore the apparatus transmits a user name and a password via printer controller 18 to another image formation apparatus and receives via the controller a result of a verification provided by another image formation apparatus.

Terminal device 6 is, as has shown in FIG. 3, a typical computer device having a CPU, a RAM, a fixed storage, a monitor, a keyboard, a mouse and the like connected thereto. Terminal device 6 operates in response to user instructions to generate and transmit print data to an image formation apparatus to which the user desires to send the data.

Hereinafter will be described an embodiment of the present invention in an example in which a user who is not registered with image formation apparatus 1 directly operates console 17 of image formation apparatus 1 to cause image formation apparatus 1 to perform some process or operates terminal device 6 to transmit print data therefrom to image formation apparatus 1, and image formation apparatus 1 requests image formation apparatuses 2-*n* to act as a proxy to perform user authentication.

<1-1> General Process by Image Formation Apparatus 1 Requesting Proxy Authentication With reference to the FIG. 7 flow chart, image formation apparatus 1 requesting proxy user authentication generally performs a process flowing as will be described hereinafter.

Upon power on or the like, CPU 11 starts the process. Initially, an initialization process such as clearing a memory, setting a standard mode, and the like is performed (step (S) 501).

After the initialization process completes, console 17 displays a user authentication screen on the display (S503). If a user desires to directly operate image formation apparatus 1 to perform a process at the image formation apparatus, the user enters a user name and a password on the user authentication screen (YES at S505), and an authentication process 1 is performed to verify the user input user name and password (S511). Authentication process 1 will be described later more specifically.

If as a result of authentication process 1 a decision is made that the verification is "OK" (YES at S513) the user presses a Log Off key on console 17 to log off (YES at S515) or CPU 11 waits until the user operates a group of key switches on console 17 of image formation apparatus 1 and performs an operation on the display to issue a request for a process (such as scanning and copying an original, performing a variety of settings, and the like) (S517).

If the user has finished using the apparatus and presses a key switch on console 17 to log off (YES at S515) the control returns to S503 to display a user authentication screen.

If the user issues a request for a process (YES at S517) then image formation apparatus 1 performs the requested process (S519) and returns to S515 and waits until the user logs off or issues a request for a subsequent process.

If with the user authentication screen displayed a user name and password is not input, image formation apparatus 1 then confirms whether printer controller 18 has received print data (S521). If so (YES at S521) authentication process 1 is performed to verify the user name and password of the user who transmitted the print data (S523). This authentication process 1 is identical to that performed at S511 and will be described later more specifically.

The user name and password of the user who transmitted the print data is stored in the print data and thus transmitted. For example, Print Job Language (PJL), a language controlling a print job, can be used to designate the user name and password, such as 'USERNAME="ito" ', 'PASSWORD="abc123"'.

If as a result of authentication process 1 at S523 a decision is made that the verification is "OK" (YES at S525), the apparatus generate an image from the print data (S527) and copies the image on a recording sheet (S529).

If as a result of authentication process 1 a decision is made that the verification is "NG" (NO at S525) then the received print data is discarded (S531) and the control returns to S505.

<1-2> Authentication Process 1

Figure 8:
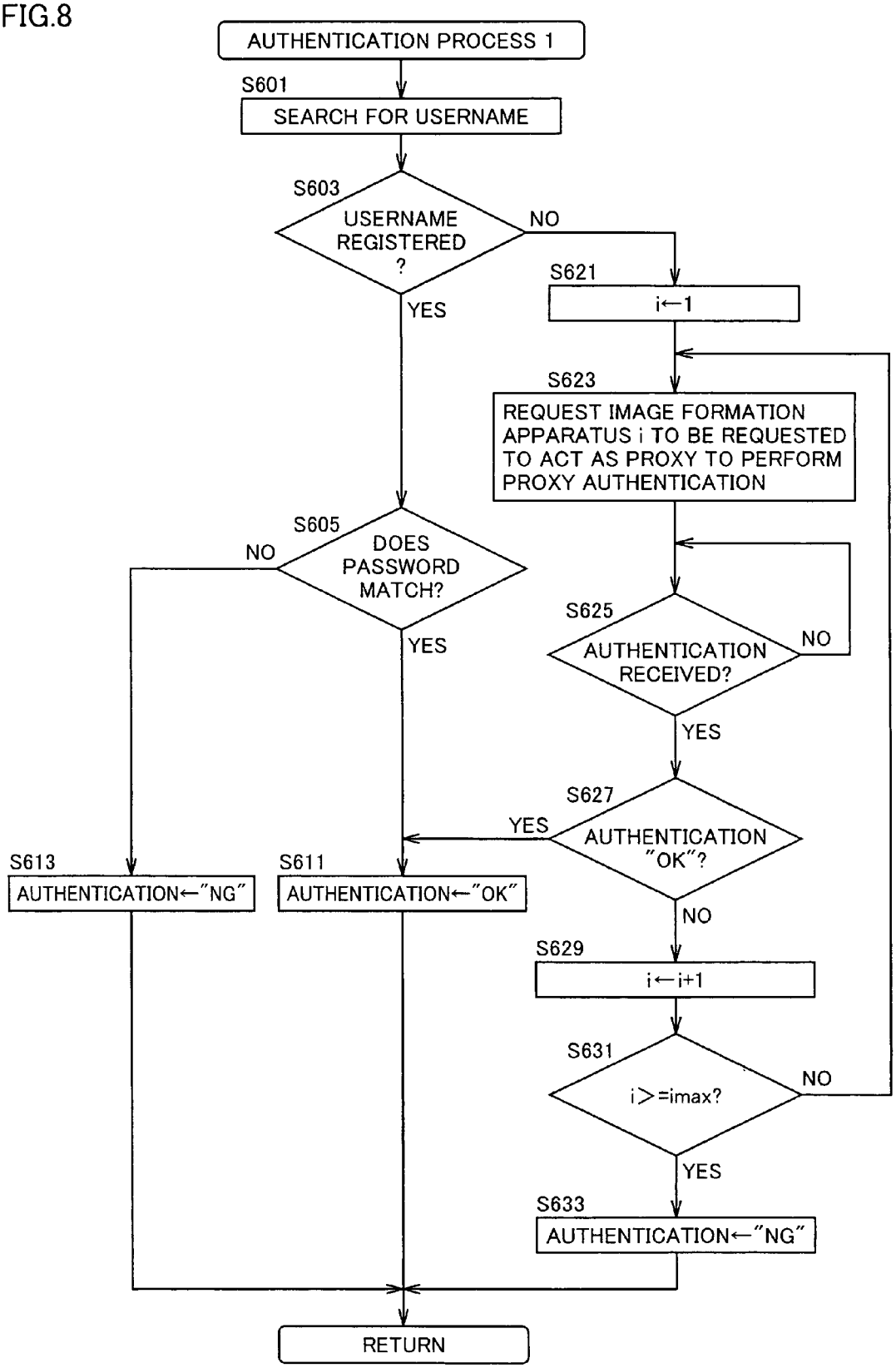
FIG. 8 is a flow chart of an authentication process 1 performed by an image formation apparatus 1.

Reference will now be made to FIG. 8 to describe authentication process 1 more specifically.

Initially CPU 11 searches the user table stored in non-volatile memory 16 to see whether a user name entered on a user authentication screen or a user name included in received print data is registered in the table (S601).

If the user name is registered in the table (YES at S603) CPU 11 confirms whether a password also input on the user authentication screen or a password also included in the received print data matches a password stored and paired with the user name (S605).

If the password matches (YES at S605) a decision is made that the verification is "OK" (S611). If the password fails to match (NO at S605) a decision is made that the verification is "NG" (S613).

If the searched user name is an unregistered user name (NO at S613) the image formation apparatus requests another image formation apparatus to act as a proxy to perform user authentication.

Initially the proxy authentication apparatus registration table stored in non-volatile memory 16 is referenced and an IP address of an image formation apparatus i located at the top of the table is read, wherein i=1 (S621) and the user name and password are transmitted to image formation apparatus i via a network (S623), and the image formation apparatus of interest waits until image formation apparatus i returns a result of authentication (S625).

If image formation apparatus i returns a resultant authentication "OK" (YES at S627) a decision is made that the authentication of interest is "OK" (S611) and the authentication process ends.

If image formation apparatus i does not return a resultant authentication "OK" (NO at S627) a subsequent image formation apparatus i as registered in the proxy authentication apparatus registration table is similarly requested to perform user authentication, similarly as performed through S623-S627, wherein i←i+1.

If all of the image formation apparatuses registered in the table are requested to perform user authentication and still there is not obtained a resultant authentication "OK" (YES at S631, where "imax" indicates the number of apparatuses registered in the proxy authentication apparatus registration table) a decision that the authentication of interest is "NG" is made and the authentication process ends (S633).

<1-3> Process by Image Formation Apparatus Requested to Perform Proxy Authentication Reference will now be made again to FIG. 7 to describe a process performed by image formation apparatuses 2-*n* requested to perform proxy authentication. For the sake of illustration, image formation apparatus 2 is requested to perform proxy authentication.

In image formation apparatus 2 CPU 11 starts the process upon power-on or the like. As has been described for image formation apparatus 1, an initialization process is performed (S501) and a user authentication screen is displayed (S503).

If no user name or password is input on the user authentication screen (NO at S505) and print data is also not received (NO at S521) CPU 11 confirms whether a request for proxy authentication has been received. If so (YES at S541) then initially the requester image formation apparatus's IP address is temporarily stored to S-RAM 15 (S543). Subsequently, an authentication process 2 is performed (S545) and the user name and password received from image formation apparatus 1 are verified against those registered with image formation apparatus 2. Authentication process 2 will be described later more specifically.

Authentication process 2 provides a resultant verification, which is returned to the requester or image formation apparatus 1 (S547). Once the resultant verification has been returned, the control deletes the IP address of the requester or image formation apparatus 1 temporarily stored and returns to S505.

<1-4> Authentication Process 2

Figure 9:
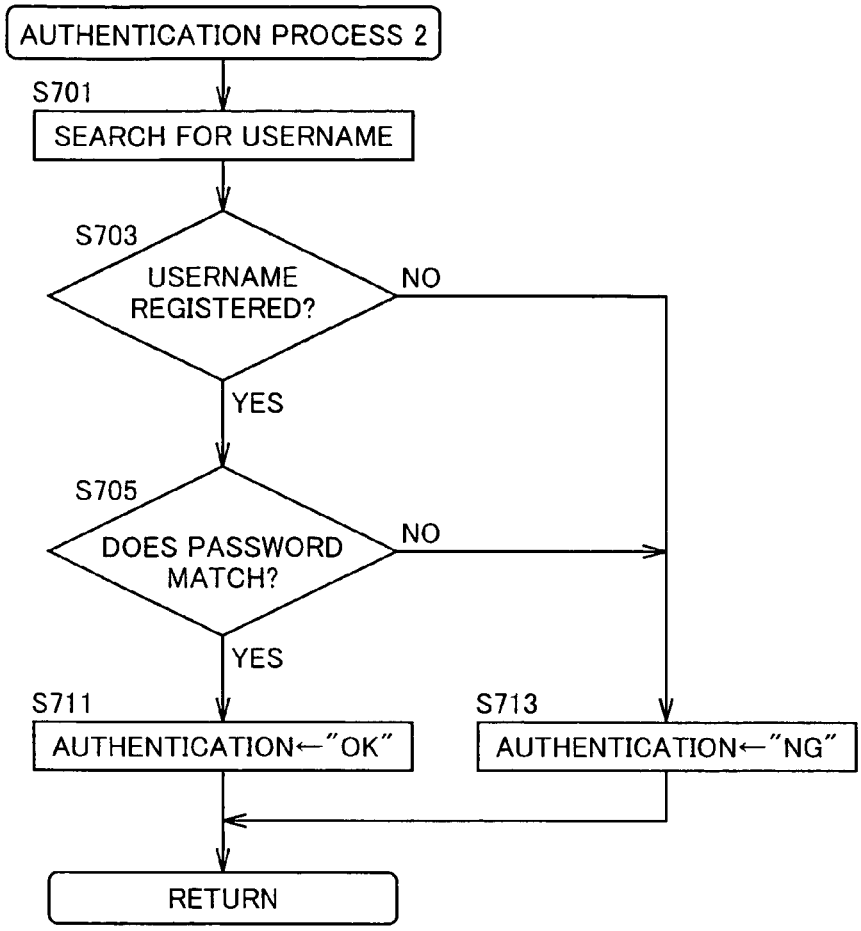
FIG. 9 is a flow chart of an authentication process 2 performed by image formation apparatuses 2-*n*.

Finally with reference to FIG. 9 authentication process 2 will be described. This process is performed by image formation apparatuses 2-*n* requested to perform proxy authentication. For the sake of illustration, image formation apparatus 2 is requested to perform proxy authentication.

Image formation apparatus 2 requested to perform proxy authentication searches for a received user name through the user table stored in non-volatile memory 16 (S701). If the user name is registered in the table (YES at S703) the control confirms whether a received password matches the password stored and paired with the user name (S705).

If the password matches (YES at S705) a decision is made that that the verification is "OK".

If the searched user name is not registered in the table (NO at S703) or the password does not match (NO at S705) a decision is made that that the verification is "NG".

Thus, as described above, if a user name and password entered by a user who desires to use a single image formation apparatus or a user name and password included in received print data is not registered with the apparatus, the apparatus requests a different, previously registered image formation apparatus to act as a proxy to perform user authentication and if the latter apparatus makes a decision that the verification is "OK" then the former apparatus permits the user to use the former apparatus or subjects the print data to an image process. If a decision is made that the verification is "NG", the former apparatus prohibits the user from using the former apparatus or discards the print data.

Figure 7:
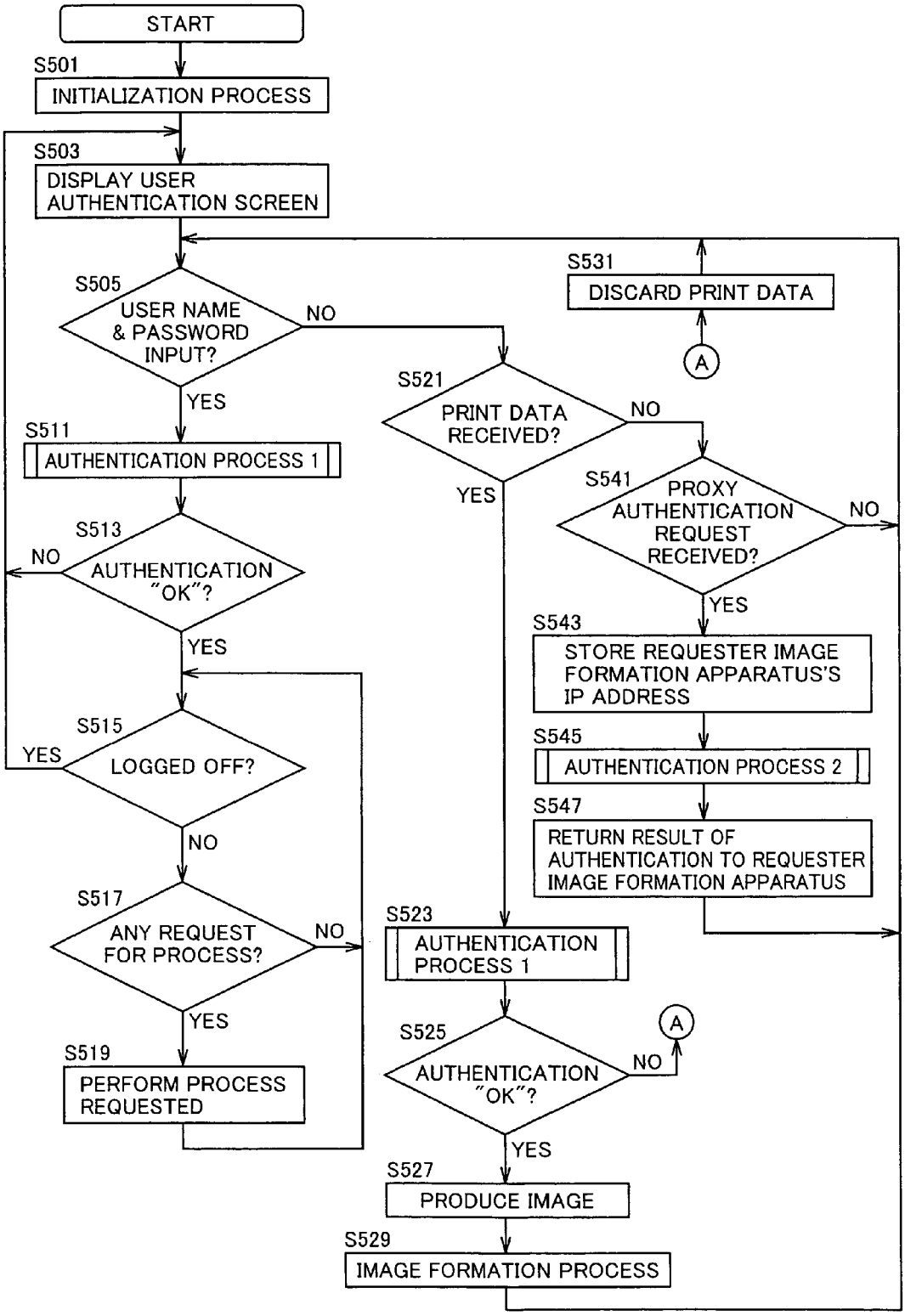
FIG. 7 is a flow chart generally representing a process performed by image formation apparatuses 1-*n*.

It should be noted while in the above embodiment image formation apparatus 1 is a requestor requesting proxy user authentication and image formation apparatus 2-*n* act as a proxy to perform user authentication, they may act vise versa, and any apparatus can be the requestor or the proxy, as illustrated in FIG. 7 collectively describing their processes.

Second Embodiment

The present invention in a second embodiment will now be described.

Figure 10:
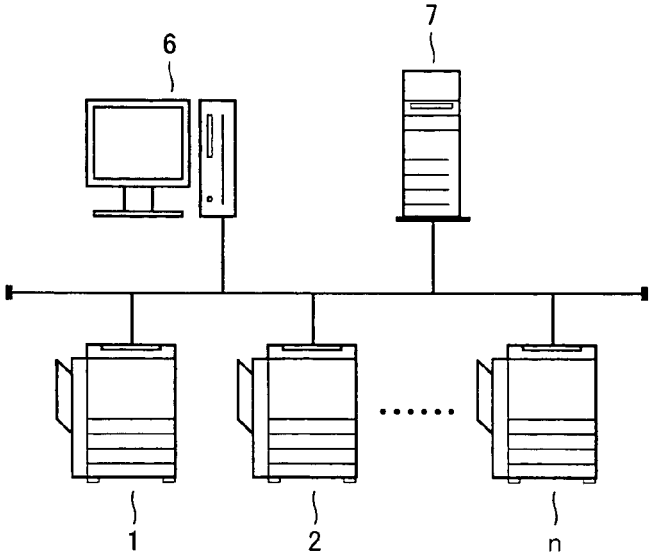
FIG. 10 shows a configuration of the image formation system in a second embodiment.

FIG. 10 shows a configuration of the present image formation system in the second embodiment.

The present image formation system is configured of image formation apparatuses 1-*n*, terminal device 6, and an authentication server 7 connected together on a network.

Image formation apparatuses 1-*n* form on a sheet a copy of an image of an original scanned and an image generated from print data transmitted from terminal device 6.

The image formation apparatus has the same internal configuration as shown in FIGS. 2 and 4.

An IP address of a different image formation apparatus performing tandem print is also entered via console 17, and transmitted to non-volatile memory 16 and stored in a tandem apparatus registration table, which is for example similar to that shown in FIG. 6.

An image formation apparatus transmits divided print data via printer controller 18 to an image formation apparatus performing tandem print.

Terminal device 6 is a typical computer device having a CPU, a RAM, a fixed storage, a monitor, a keyboard, a mouse and the like connected thereto (see FIG. 3) and operates in response to user instructions to generate and transmit print data to an image formation apparatus which the user desires to use.

Authentication server 7 is a typical computer device having a CPU, a RAM, a fixed storage, a monitor, a keyboard, a mouse and the like connected thereto (see FIG. 3) and operates in response to a request received from any apparatus connected to a network to perform a user authentication process in a unified manner. The authentication server 7 fixed storage device has stored therein a user name and password entered via a keyboard. The user name and password are stored in a user table, which is similar to the FIG. 5 user table.

In the following description, image formation apparatus 1 receiving print data from terminal device 6 acts as a parent apparatus and image formation apparatus 2-*n* acts as a child apparatus to perform tandem print for the sake of illustration to describe the present embodiment.

<2-1> General Process by Image Formation Apparatus 1 Acting as Parent Apparatus to Perform Tandem Print Initially reference will be made to FIG. 11 to describe a general process performed by image formation apparatus 1 acting as a parent apparatus to perform tandem print.

Upon power on or the like, CPU 11 starts the process. Initially, an initialization process such as clearing a memory, setting a standard mode, and the like is performed (S1201).

After the initialization process completes, console 17 displays a user authentication screen on the display (S1203). If a user desires to directly operate image formation apparatus 1 to perform a process at the image formation apparatus, the user enters a user name and a password on the user authentication screen (YES at S1205), and an authentication process 3 is performed to verify the user input user name and password (S1211). Authentication process 3 will be described later more specifically.

If as a result of authentication process 3 a decision is, made that the verification is "OK" (YES at S1213) the user presses the Log Off key on console 17 to log off (YES at S1215) or CPU 11 waits until the user operates a group of key switches on console 17 of image formation apparatus 1 and performs an operation on the display to issue a request for a process (such as scanning and copying an original, performing a variety of settings, and the like) (S1217).

If the user has finished using the apparatus and presses a key switch on console 17 to log off (YES at S1215) the control returns to S1203 to display a user authentication screen.

If the user issues a request for a process (YES at S1217) then image formation apparatus 1 performs the requested process (S1219) and returns to S1215 and waits until the user logs off or issues a request for a subsequent process.

If with the user authentication screen displayed a user name and password is not input, image formation apparatus 1 then confirms whether printer controller 18 has received print data (S1221). If so (YES S1221) the control confirms whether together with the print data, information indicating that authentication has been done has been transmitted (S1223).

The information indicating that authentication has been done is information attached when a parent apparatus performing tandem print transmits print data to a child apparatus. When terminal device 6 transmits print data the information is not attached. Accordingly, in the image formation apparatus acting as a parent apparatus to perform tandem print, the S1223 decision will be "NO".

Subsequently at S1225 is performed a user authentication process authenticating a user who transmitted print data. This user authentication process is identical to authentication process 3 performed at S1211 and will be described later more specifically.

Note that the user name and password of the user who transmitted the print data is transmitted together with the print data. For example, Print Job Language (PJL), a language controlling a print job, can be used to designate the user name and password, such as 'USERNAME="ito"', 'PASSWORD="abc123"'.

At S1225 authentication process 3 is performed and if a decision is made that the verification is "OK" (YES at S1227) then by a tandem print process at S1229 a different, tandem image formation apparatus (or image formation apparatus 2-*n*) is instructed to perform a divided print job. The tandem print process will be described later more specifically.

After image formation apparatus 1 has instructed the different, tandem image formation apparatus, image formation apparatus 1 processes the print data itself. More specifically, image formation apparatus 1 generates an image from print data representing a print job assigned thereto (S1231) and copies the generated image on a recording sheet (S1233). When image formation apparatus 1 has completed its own image formation process, image formation apparatus 1 returns to S1205 and continues process.

If at S1227 a resultant authentication is "NG" then the received print data is discarded (S1235) and the control returns to S1205 and continues process.

<2-2> Authentication Process 3

Authentication process 3 is performed in two manners: in one case, a user table stored in image formation apparatus 1 at non-volatile memory 16 is referenced; and in the other case, authentication server 7 is requested to perform an authentication process, as will be described hereinafter.

Authentication Process 3-*a*

Figure 12:
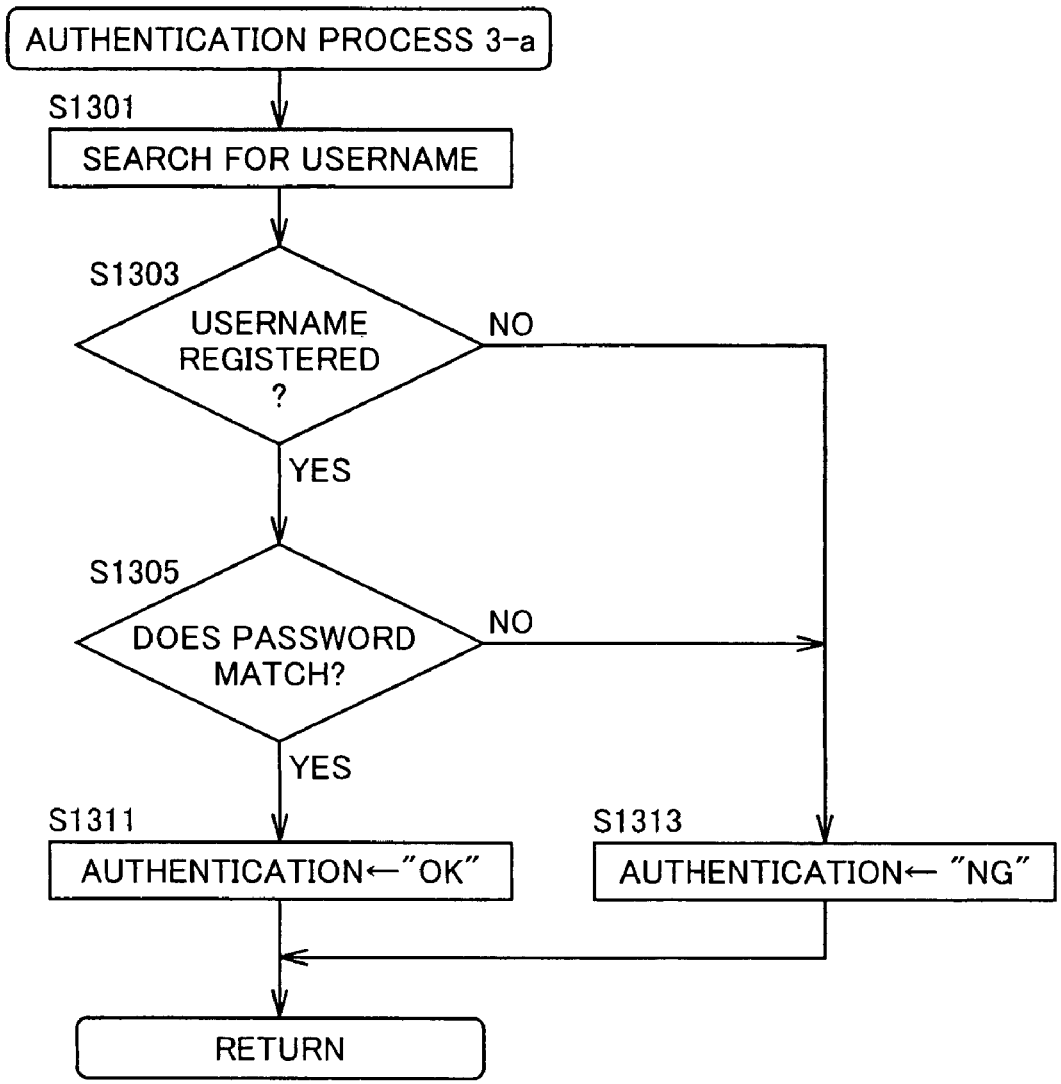
FIGS. 12 and 13 are flow charts of authentication processes 3-*a* and 3-*b*, respectively, performed by image formation apparatus 1.

With reference to FIG. 12 a process will be described that performs authentication with reference to the user table stored in image formation apparatus 1 at non-volatile memory 16.

CPU 11 searches the user table stored in non-volatile memory 16 to see whether a received user name is registered in the table (S1301). If the user name is registered in the table (YES at S1303) CPU 11 confirms whether a received password matches a password stored and paired with the user name (S1305).

If the password matches (YES at S1305) a decision is made that the verification is "OK" (S1311).

If the searched user name is an unregistered user name (NO at S1303) or the password does not match (NO at S1305) a decision is made that the verification is "NG" (S1313).

Authentication Process 3-*b*

Figure 13:
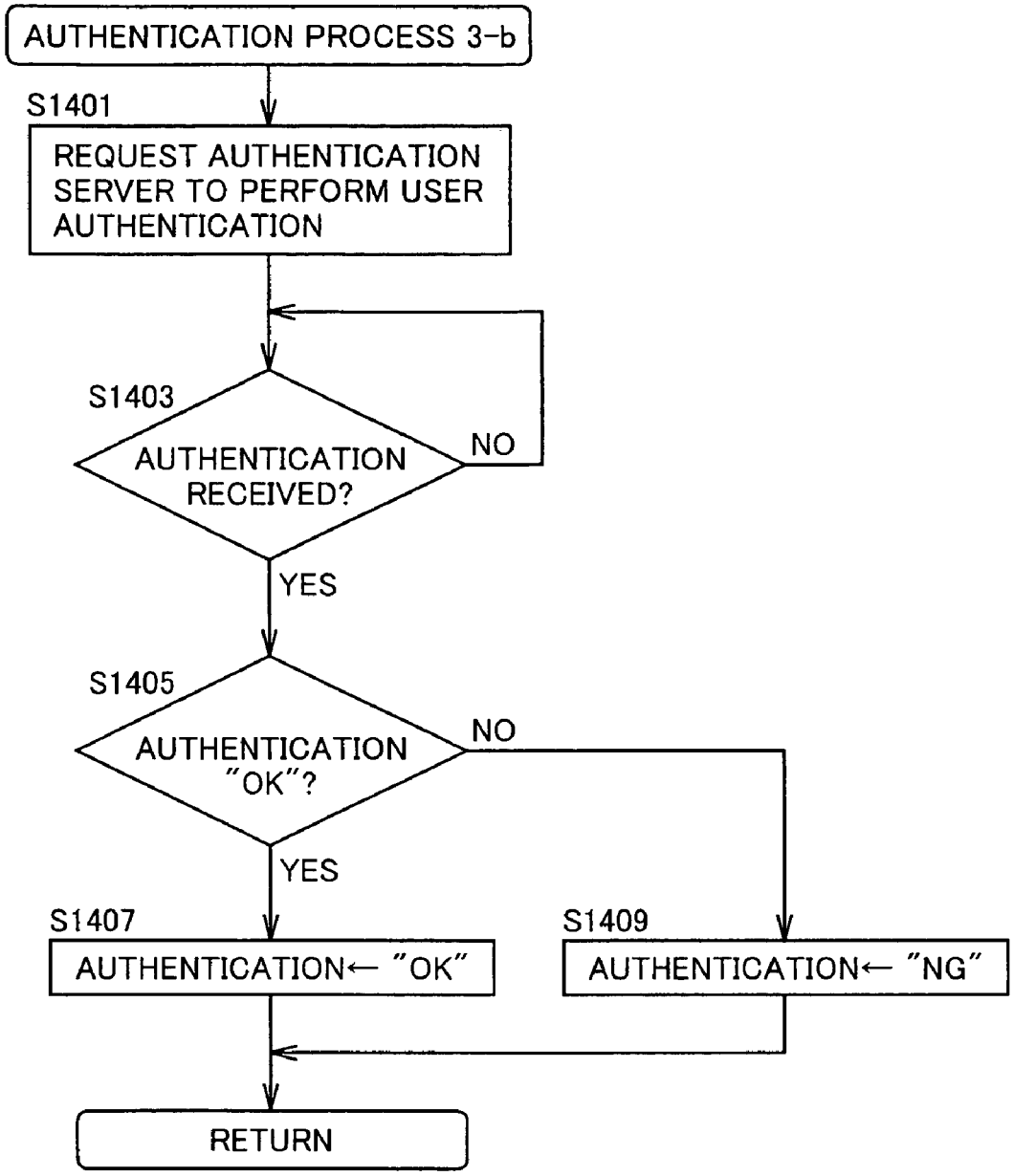

With reference to FIG. 13, image formation apparatus 1 requests authentication server 7 to perform an authentication process, as described hereinafter.

Initially, image formation apparatus 1 transmits a user name and password to authentication server 7 and requests authentication server 7 to perform user authentication (S1401). Image formation apparatus 1 waits until authentication server 7 performs user authentication and returns a result thereof (S1403). Authentication server 7 returns an authentication and if the authentication indicates a result "OK" (YES at S1405) a decision is made that the authentication of interest is "OK" (S1407). If the authentication server does not return an authentication "OK" (NO at S1405) then a decision is made that the authentication of interest is "NG" (S1409).

Authentication server 7 performs an authentication process similarly as has been described for authentication process 3-*a*. More specifically, a user name and password received from image formation apparatus 1 is verified against those in the user table stored in authentication server 7 at a fixed storage device.

<2-3' Tandem Print Process

Figure 14:
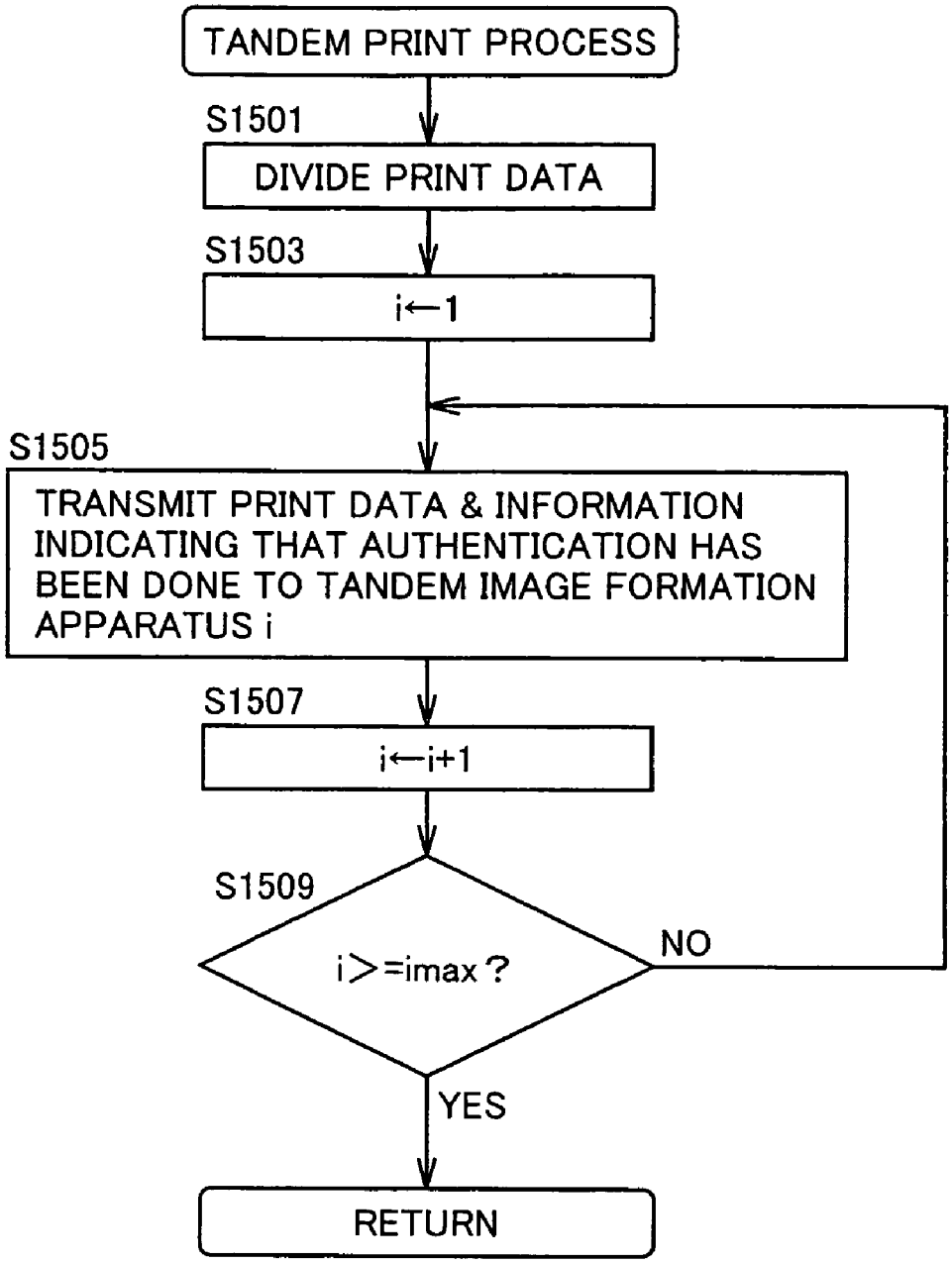
FIG. 14 is a flow chart of a tandem print process performed by image formation apparatus 1.

With reference to FIG. 14, image formation apparatus 1 acting as a parent apparatus performs a tandem print process, as will be described hereinafter.

Image formation apparatus 1 creates print data, which is print data received from terminal device 6 and divided into a plurality of print jobs (S1501). For example, if three image formation apparatuses are registered in the tandem apparatus registration table, print data divided into four print jobs are generated for the three image formation apparatuses and image formation apparatus 1. More specifically, for example for a print job designated to provide ten prints, two print data having rewritten the number of prints of the original print data designated from "10" to "3" and two print data having rewritten the number of prints of the original print data designated from "10" to "2" are generated.

The generated print data are then transmitted to the image formation apparatuses performing tandem print (S1503-S1509). In doing so, together with the print data, information is transmitted indicating that authentication has been done. For example, the PJL can be used to indicate that authentication has been done, such as "AUTHENTICATION=PASSED".

If the print data have been transmitted to all of the image formation apparatuses performing tandem print (YES at S1509, where "imax" indicates the number of image formation apparatuses registered in the tandem apparatus registration table excluding the parent apparatus) the tandem print process ends.

<2-4> Process by Image Formation Apparatus Acting as Child Apparatus to Perform Tandem Print Finally, with reference again to FIG. 11, tandem print is performed by a child apparatus or image formation apparatus 2-*n*, as will be described hereinafter.

Similarly as has been described for the parent apparatus or image formation apparatus 1, CPU 11 starts the process upon power-on and after an initialization process is performed (S1201) a user authentication screen is displayed on console 17 by a display device (S1203).

When the image formation apparatus receives a print job (YES at S1221) the control confirms whether information indicating that authentication has been done has been transmitted together with print data (S1223). As has been described for the parent apparatus's tandem print process, print data received from the parent apparatus has attached thereto information indicating that authentication has been done. Accordingly, in the image formation apparatus acting as a child apparatus to perform tandem print, the S1223 decision will be "YES".

As a result, authentication process 3 is skipped and a process is immediately performed to form an image of the print data. More specifically, the image formation apparatus generates an image from print data representing a print job assigned to itself (S1231) and copies the generated image on a recording sheet (S1233). If the apparatus completes its own image formation process, the control returns to S1205 to continue process.

Thus, as has been described above, if a plurality of image formation apparatuses perform tandem print and once an image formation apparatus acting as a parent apparatus or an authentication server has performed user authentication, an image formation apparatus acting as a child apparatus will not perform user authentication, and immediately perform an image formation process.

Figure 11:
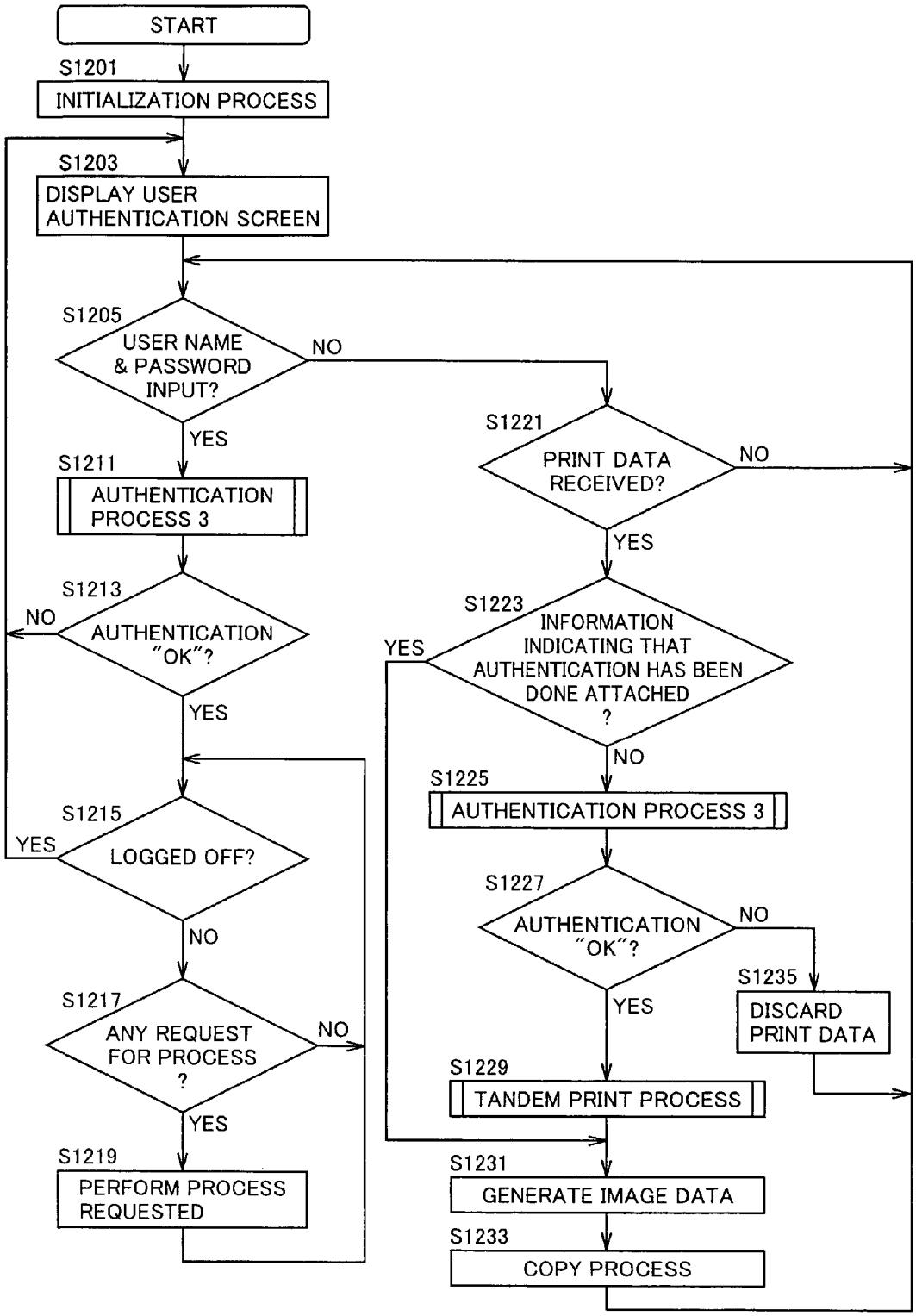
FIG. 11 is a flow chart generally representing a process performed by image formation apparatuses 1-*n* in the second embodiment.

It should be noted that while in the above, one apparatus acts as a parent apparatus and another as a child to perform tandem process, they may act vise versa, and any apparatus can act as a parent or a child, as illustrated in FIG. 11 collectively describing their processes.

While the above description is provided in connection with a tandem print process for print data received from terminal device 6, the present invention is also applicable to a tandem print process for an image of an original scanned in image formation apparatus 1.

EFFECT IN THE EMBODIMENT

The present image formation apparatus can eliminate the necessity of registering a user with image formation apparatuses redundantly and also prevent a user registered with an image formation apparatus that is in an intended range from improperly using the image formation apparatus of interest.

Thus for example in an image formation system performing tandem print by a plurality of image formation apparatuses the necessity can be eliminated of registering a user redundantly with all tandem image formation apparatuses while a user registered with an image formation apparatus that is not to be tandemed can be prevented from improperly executing a tandem print.

Furthermore, the necessity can be eliminated of registering a user redundantly with all of the image formation apparatuses owned by a single organization while a user belonging to a different organization connected on a network can use an identical user name.

Furthermore, if a plurality of image formation apparatuses performing user authentication are tandemed to perform an image formation operation, the individual image formation apparatuses will no longer perform a user authentication process redundantly and a reduced overall period of time required to perform an image formation process can be achieved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image formation system including at least two image formation apparatuses interconnected on a network, wherein:

a first one of the image formation apparatuses comprises an input device operated to input user identification information, a first user register registering user identification information of a user authorized to use said first image formation apparatus, a first verifier performing a verification as to whether the user identification information input via said input device matches that registered with said first user register, a tandem apparatus register registering a different image formation apparatus performing tandem print, a generator generating a plurality of tandem print data from print data, and a transmitter operative in response to said first verifier providing a successful verification to transmit to a second image formation apparatus registered with said tandem apparatus register said tandem print data together with verification information indicating that the verification has succeeded; and said second image formation apparatus comprises an input device operated to input user identification information, a receiver receiving print data, a second user register registering user identification information of a user authorized to use said second image formation apparatus, a second verifier performing a verification as to whether the user identification information input via said input device matches that registered with said second user register, and a controller providing control to perform an image formation process without said second verifier's verification if print data received from said receiver includes information of verification by a different image formation apparatus.

2. The image formation system of claim 1, wherein said input device is a print data receiver receiving print data including the user identification information.

3. The image formation system of claim 1, wherein the user identification information includes an ID or a password identifying the user.

4. An image formation apparatus connectable to a different, image formation apparatus on a network, comprising:

an input device operated to input user identification information;

a user register registering user identification information of a user authorized to use the image formation apparatus;

a verifier performing a verification as to whether the user identification information input via said input device matches that registered with said user register;

a tandem apparatus register registering a different image formation apparatus performing tandem print;

a generator generating a plurality of tandem print data from print data; and a transmitter operative in response to said verifier providing a successful verification to transmit to a image formation apparatus registered with said tandem apparatus register said tandem print data together with verification information indicating that the verification has succeeded.

5. An image formation system including at least two image formation apparatuses interconnected on a network, and a user verification device receiving user identification information transmitted from an image formation apparatus, and verifying whether the user identification information matches that of a user authorized to use the source image formation apparatus, wherein:

a first one of the image formation apparatuses comprises an input device operated to input user identification information, a first external verifier requesting said user verification device to perform verification of the user identification information input via said input device, and receiving the verification, a tandem apparatus register registering a different image formation apparatus performing tandem print, a generator generating a plurality of tandem print data from print data, and a transmitter operative in response to said first external verifier providing a successful verification to transmit to a second image formation apparatus registered with said tandem apparatus register said tandem print data together with verification information indicating that the verification has succeeded; and said second image formation apparatus comprises an input device operated to input user identification information, receiver receiving print data, second external verifier requesting said user verification device to perform verification of the user identification information input via said input device, and receiving the verification, and a controller providing control to perform an image formation process without said second external verifiers verification if print data received from said receiver includes information of verification by said user verification device.

* * * * *